US006338214B1

(12) United States Patent
Held

(10) Patent No.: US 6,338,214 B1
(45) Date of Patent: Jan. 15, 2002

(54) MODULAR SIGN DISPLAY

(76) Inventor: Randy Held, 5004 Steelhead St., Juneau, AK (US) 11791

( * ) Notice: Subject to any disclaimer, the term of this patent is extended or adjusted under 35 U.S.C. 154(b) by 0 days.

(21) Appl. No.: 09/375,188

(22) Filed: Aug. 16, 1999

(51) Int. Cl.[7] ..... G09F 7/00

(52) U.S. Cl. ..... 40/620; 40/595; 40/612; 40/618; 40/621

(58) Field of Search ..... 40/606, 612, 618, 40/620, 621, 595

(56) References Cited

U.S. PATENT DOCUMENTS

| | | | | | |
|---|---|---|---|---|---|
| 156,959 | A | * | 11/1874 | Taylor | 40/620 |
| 2,451,775 | A | * | 10/1948 | Roher | 40/595 |
| 3,440,746 | A | * | 4/1969 | Richards | 40/595 |
| 3,883,967 | A | * | 5/1975 | Barnes | 40/620 X |
| 3,965,599 | A | * | 6/1976 | Ebner | 40/600 X |
| 4,040,194 | A | * | 8/1977 | Penton et al. | 40/620 X |
| 4,138,787 | A | * | 2/1979 | Sarkisian et al. | 40/618 |
| 4,876,812 | A | * | 10/1989 | Haralson | 40/618 X |
| 4,999,938 | A | * | 3/1991 | Behling | 40/612 X |
| 5,088,221 | A | * | 2/1992 | Bussiere et al. | 40/618 |
| 6,178,679 | B1 | * | 1/2001 | Dundorf | 40/618 |

* cited by examiner

*Primary Examiner*—Brian K. Green
*Assistant Examiner*—James M Hewitt
(74) *Attorney, Agent, or Firm*—Michael I. Kroll

(57) ABSTRACT

The present invention 10 discloses a kit for creating messages 18 for road signs 14. Included is a road sign blank 20 having a plurality of ferrous-like strips 22 mounted thereon, wherein the strips are sized to receive properly sized magnetic letters 24 which will form the words 36 of the message on the sign. A template 26 is provided having perpendicular alignment projections 28 thereon wherein the projections 28 are selectively placed in order to properly position the template 26 in relation to the sign 20 so that the magnetic letters 24 can be properly placed on the sign 20 by placing the letters 24 in cooperation with a plurality of numbers 30 and tic marks 32 selectively visibly placed on the template 26.

8 Claims, 14 Drawing Sheets

MODULAR SIGN DISPLAY

BACKGROUND OF THE INVENTION

1. Field of the Invention

The present invention relates generally to roadway signage and, more specifically, to a kit which can be used on site to create warning signs as to potentially hazardous conditions, such as construction sites and/or the presence of maintenance crews. The criteria for the size, number, and words of said signs is dictated by standards published by the Department of Transportation. The present invention is comprised of a kit having one or more blank signs conforming to said standards wherein the sign being constructed from any appropriate material has strips of ferrous-like material applied to the surface of said sign whereby a number of magnetic letters and symbols conforming to said standards can be removably attached to said blank sign. The positioning of said letters is also mandated by the DOT and described under the "Manual of Uniform Traffic Control Devices" and it is this standard which is embossed or imprinted on a template having means for placing said template onto a blank sign in a consistent manner and positioning a plurality of letter according to the dictates located on the front and back face of the template.

2. Description of the Prior Art

Construction warning signs call attention to conditions on, adjacent to, a highway or street that are potentially hazardous to traffic operations. These diamond shaped signs with orange background and black lettering are required to warn of existing or possible hazards on or along the highway. Such signs are defined in (MUTCD) manual on Uniform Traffic Control Devices approved by the Federal Highway Administrator as the national standard. The standard sign in use is a four foot by four foot sign but requirements may be as small as three feet by three feet up to eight feet by eight feet and perhaps greater. The quantity required for any given job may be as little as one sign up to as many as thirty, possibly more. The wording requirements are defined as national standards but may be varied as needed for specific requirement. This requires that companies performing work along roadways maintain a considerable inventory of various sized signs and various words. This has led to an undesirable burden placed on such companies in that not only must they store and maintain this inventory but must also be able to cart them to a job site.

It is with this in mind that it is felt that a need exists for the present invention which will allow these companies to carry a kit comprising one or more blank signs, a quantity of magnetic letters, and a template having the various guidelines for the placement of said letters whereby the necessary warning signs can be assembled on the job site on a need be basis.

SUMMARY OF THE PRESENT INVENTION

The present invention relates generally to roadway signage and, more specifically, to a kit which can be used on site to create warning signs as to potentially hazardous conditions, such as construction sites and/or the presence of maintenance crews. The criteria for the size, number, and words of said signs are dictated by standards published by the Department of Transportation. The present invention is comprised of a kit having one or more blank signs conforming to said standards wherein the sign being constructed from any appropriate material has strips of ferrous-like material applied to the surface of said sign whereby a number of magnetic letters conforming to said standards can be removably attached to said blank sign. The positioning of said letters is also mandated by the DOT and described under the "Manual of Uniform Traffic Control Devices" and it is this standard which is embossed or imprinted on a template having means for placing said template onto a blank sign in a consistent manner and positioning a plurality of letter according to the dictates located on the front and back face of the template.

A primary object of the present invention is to provide a means for assembling one or more warning signs at a job site location meeting the Department of Transportation standards as outlined in the (MUTCD) Manual on Uniform Traffic Control Devices.

Another object of the present invention is to provide a kit having one or more blank signs having strips of ferrous-like material imbedded within the surface of said blank signs.

Another object of the present invention is to provide a kit having one or more blank signs having strips of ferrous-like material imbedded within the surface of said blank signs and a quantity of magnetic letters which can be attached to the ferrous-like strips located on said sign.

A still further object of the present invention is to provide a kit having one or more blank signs having strips of ferrous-like material imbedded within the surface of said blank signs and a quantity of magnetic letters which can be attached to the ferrous-like strips located on said sign and a template having engraved, embossed, or imprint on the front and rear face of said template the placement, spacing, and alignment of the magnetic lettering used to create the warning signs. It should also be noted that the magnetic media is not limited to the alphabet but may include numbers, symbols, and pictures.

Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

Wherein the first word has four letters the upper left hand corner of the first letter is placed under the tic mark labeled four.

Figure 5:
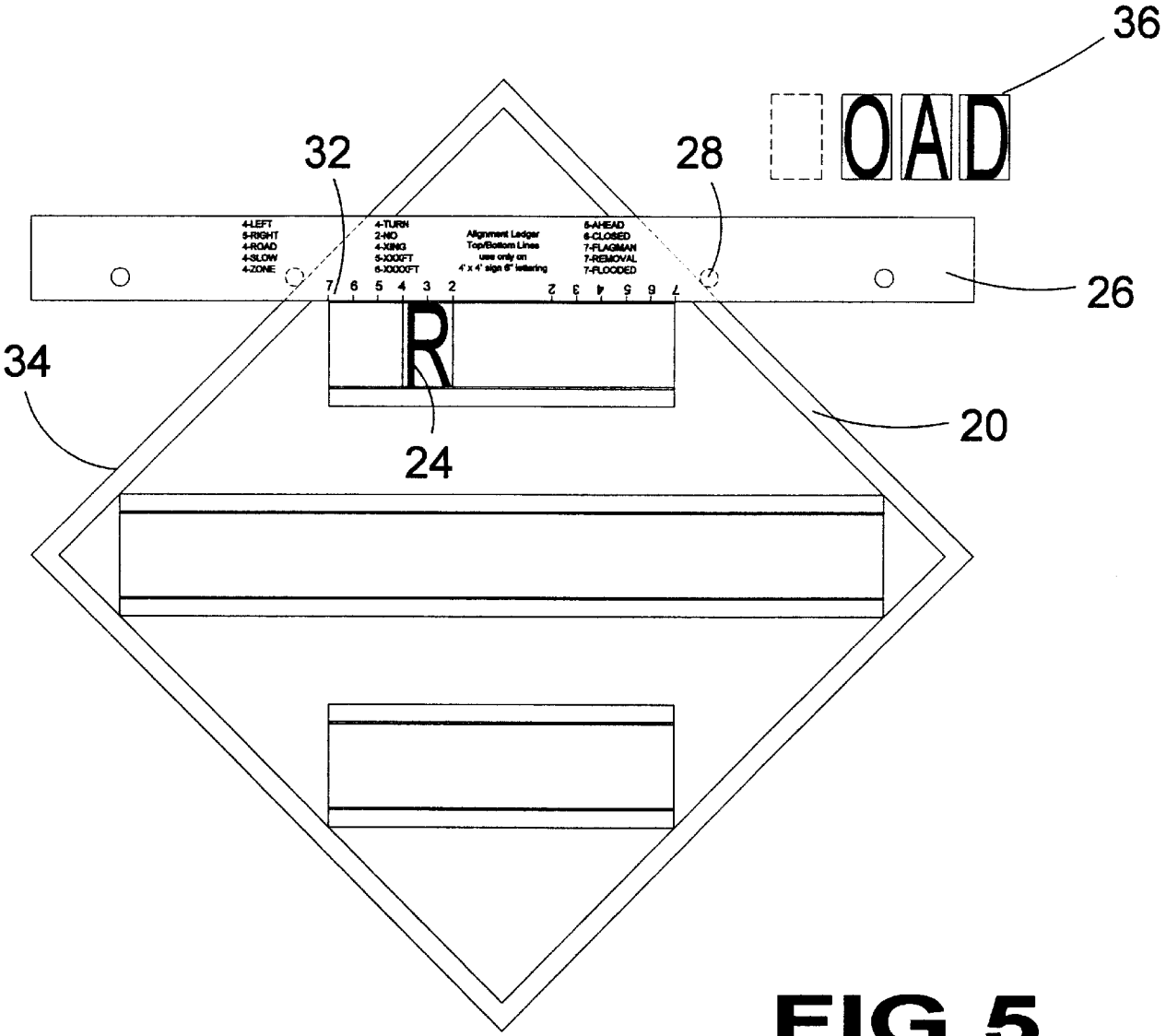
FIG. 5 is a front elevation of a warning sign being constructed. Shown is the template placed on the top edges of the sign for positioning the first word of sign text.
Figure 5A:
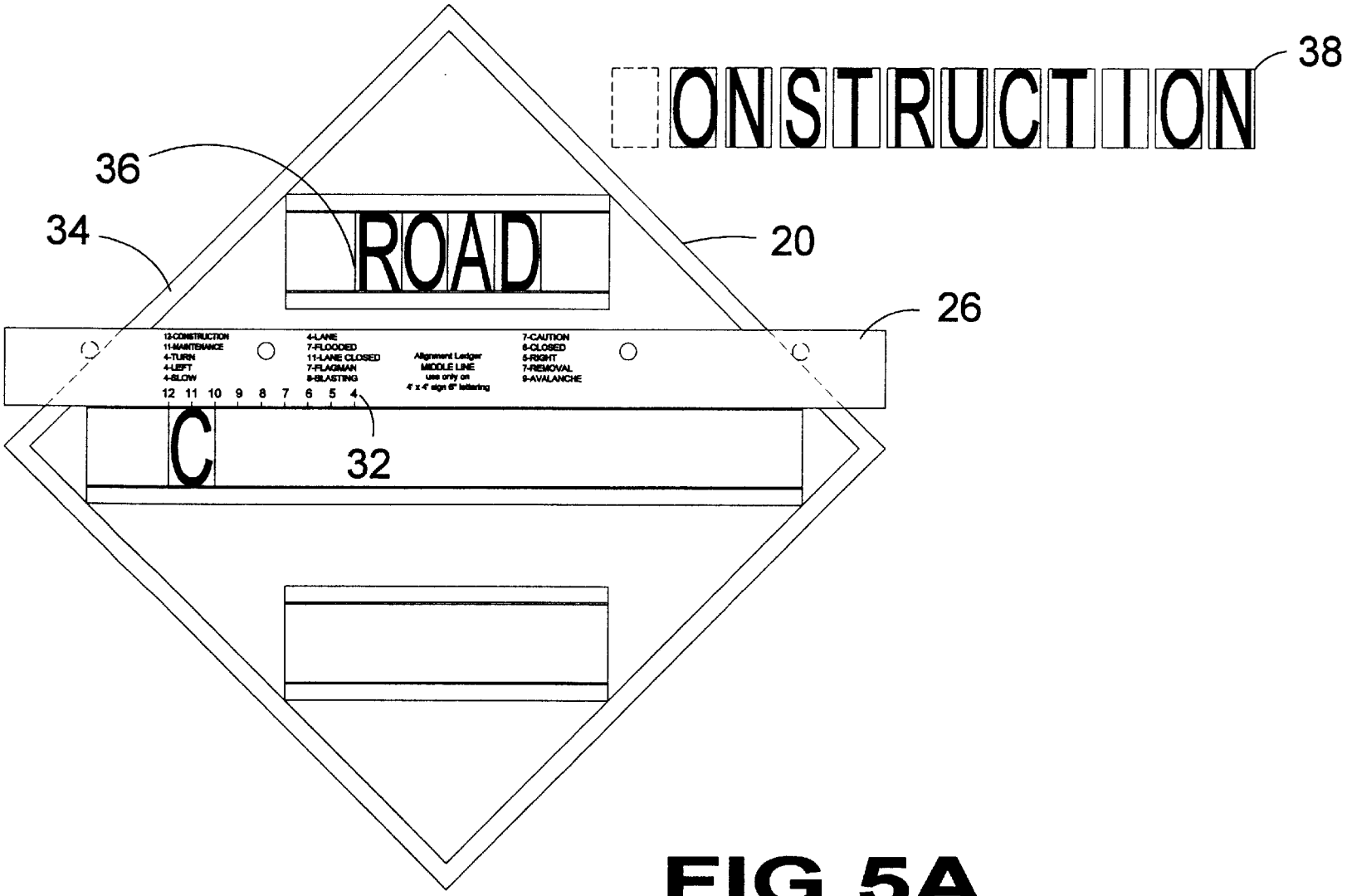

FIG. 5A is a front elevation of the warning sign shown in FIG. 5. Shown is the first word having been completed, the template is reversed and again placed on the top edges of the sign wherein it will align with the second row. Wherein the second word has twelve letters, the upper left hand corner of the first letter is placed under the tic mark labeled twelve.

Figure 5B:
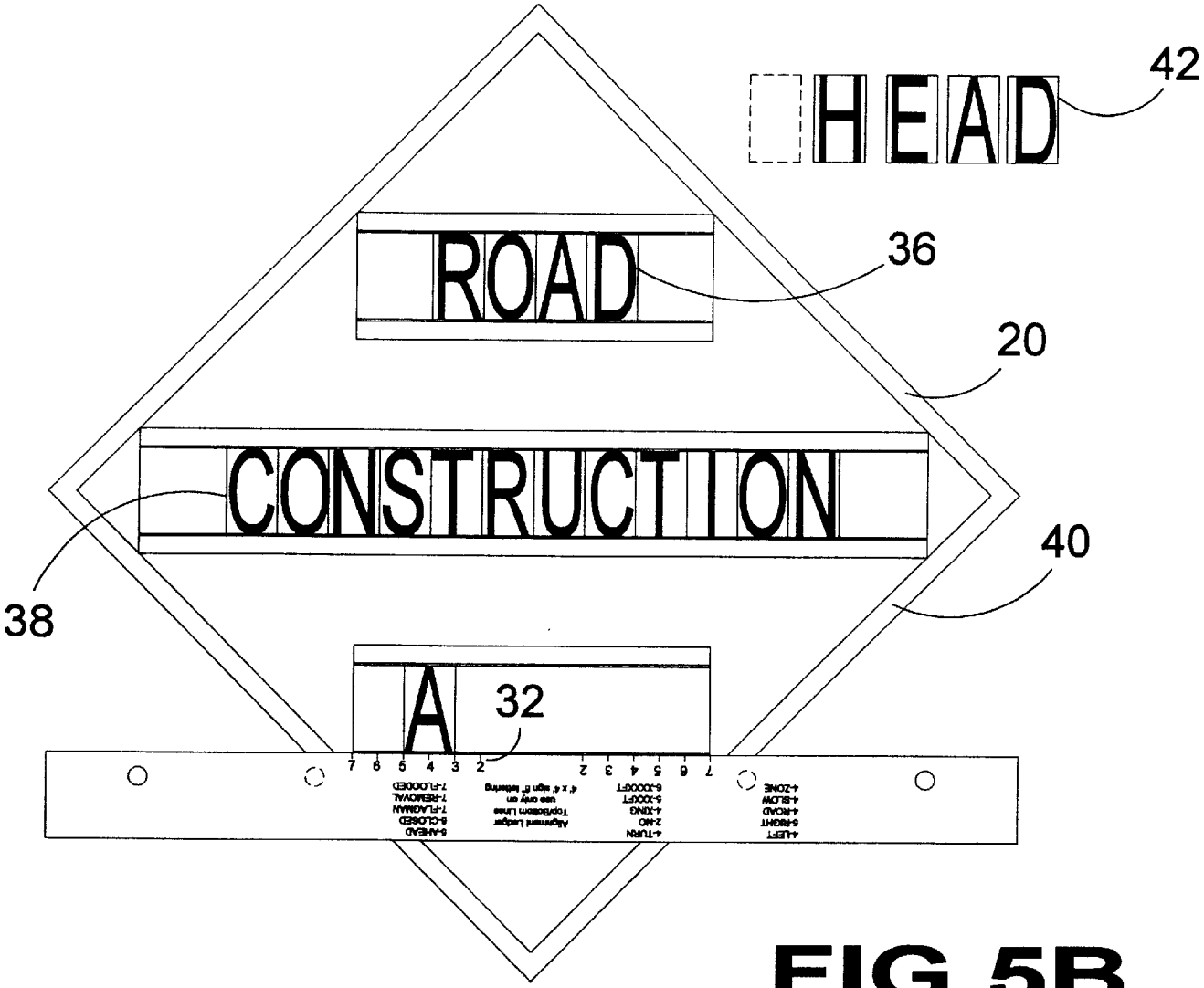

FIG. 5B is a front elevation of the warning sign shown in FIGS. 5 and 5A. Shown is the second word having been completed the template is reversed and placed on the bottom of the sign wherein it will align with the third row. Wherein the third word has five letters, the lower left hand corner of the first letter is placed above the tic mark labeled five.

Figure 1:
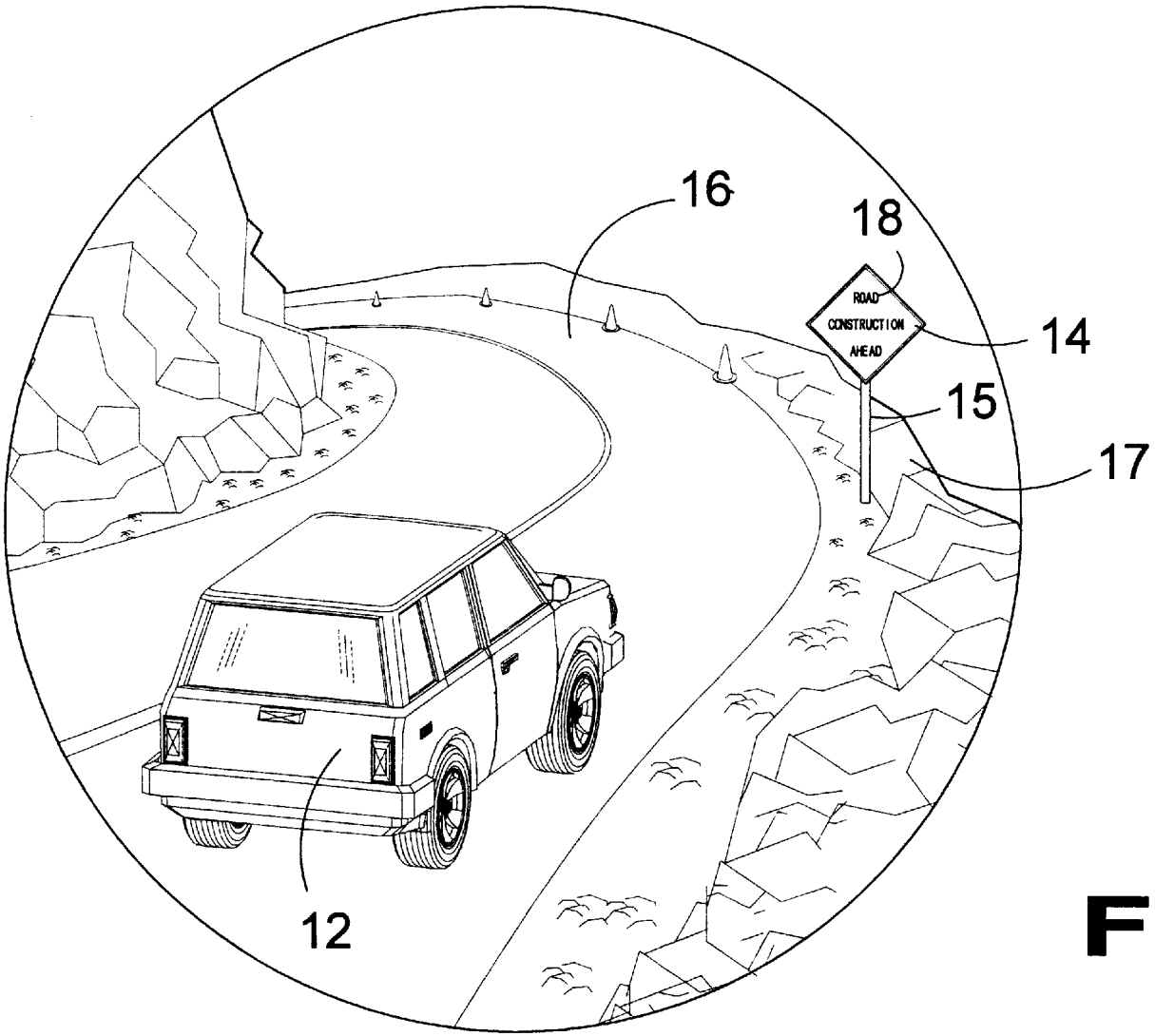
FIG. 1 is an illustration of a motor vehicle approaching a highway warning sign which has been constructed using a blank sign, magnetic lettering and a template which was used in the placement of the warning sign message.
Figure 1A:
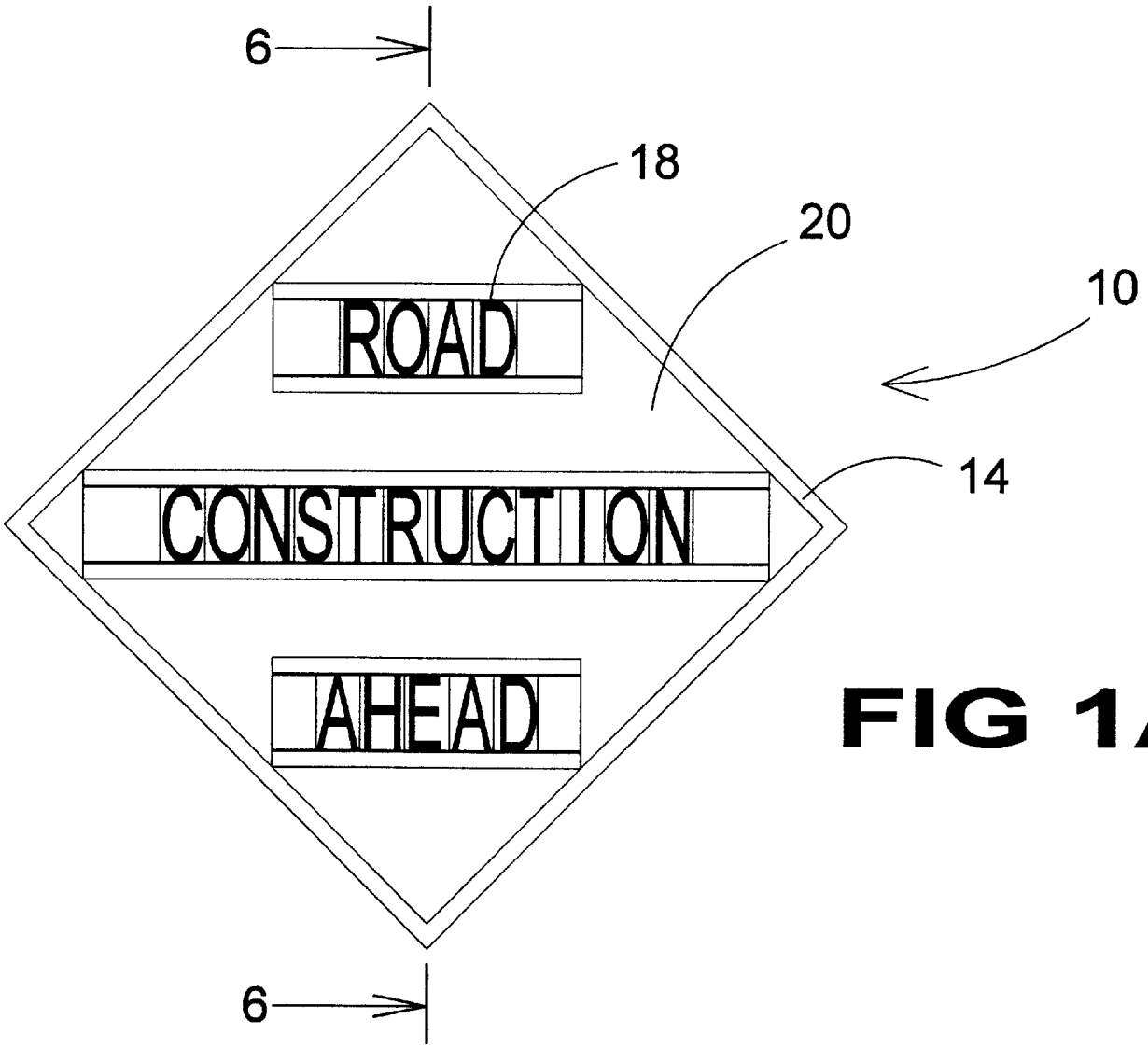
FIG. 1A is an enlarged front elevation of the sign of the present invention as shown in FIG. 1. Shown is a sign blank having a road warning message assembled thereon using the template of the present invention to determine the proper placement of said letters.
Figure 6:
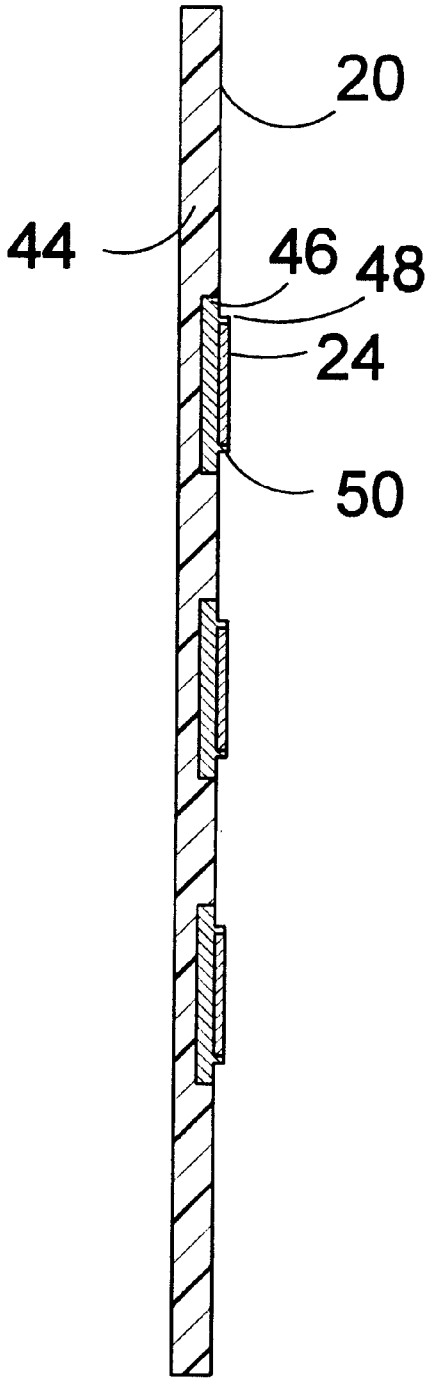

FIG. 6 is a cross sectional view of the present invention taken from FIG. 1A as indicated. Shown is a backing material used for the blank sign having ferrous-like strips embedded within the backing material having an upper an lower ledge. The upper ledge is used to support the template in a parallel horizontal position from the center of the sign and the lower edge is used to support the magnetized letters.

Figure 7:
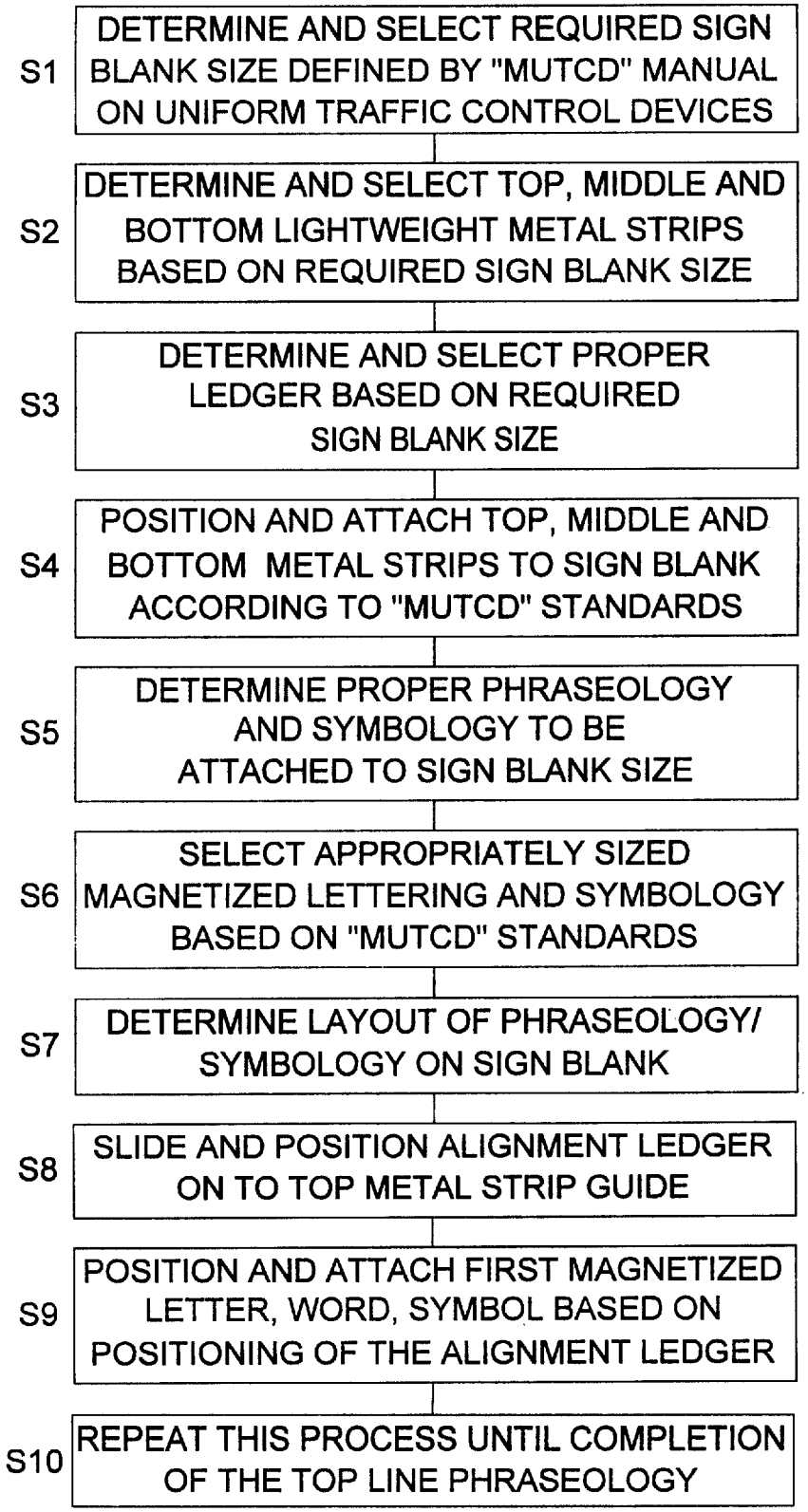
Figure 7A:
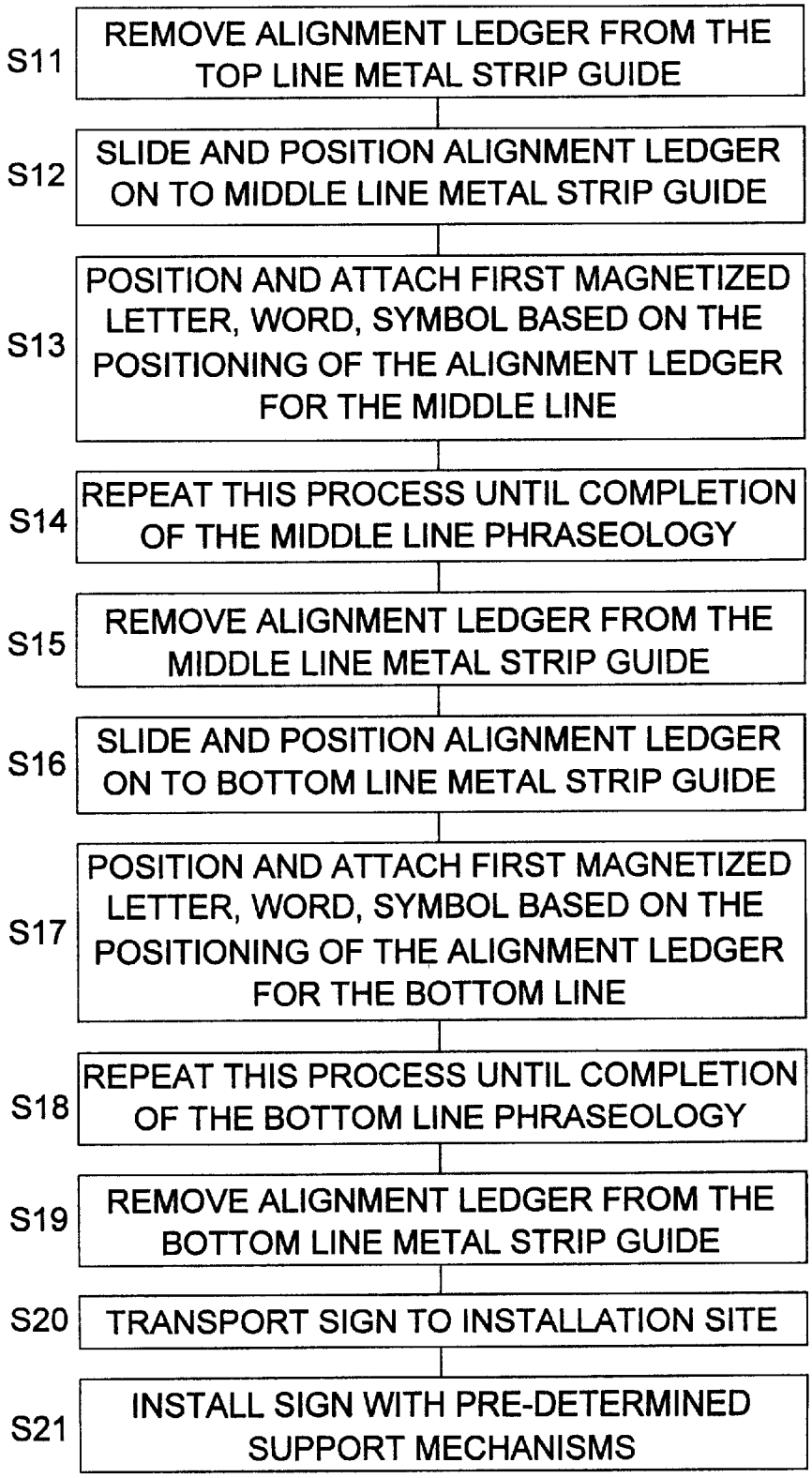

FIGS. 7–7A is a description of the method used to create a warning sign from the components of the sign kit.

LIST OF REFERENCE NUMERALS

With regard to reference numerals used, the following numbering is used the drawings.

10 present invention
12 vehicle
14 warning sign
15 pole
16 highway
17 ground
18 warning sign message
20 sign blank
22 ferrous material
24 sign letters
26 template
28 alignment projections
29 exemplary words
30 numbers
31 number of letters
32 tic marks
34 top edge of sign
36 first word
38 second word
40 bottom edge of sign
42 third word
44 backing material
46 ferrous-like strips
48 upper ledge
50 lower ledge

DESCRIPTION OF THE PREFERRED EMBODIMENT(S)

Turning now descriptively to the drawings, in which similar reference characters denote similar elements throughout the several views, FIGS. 1 through 7A illustrate the present invention being a kit for assembly of a road sign.

Turning to FIG. 1, shown therein is an illustration of a motor vehicle 12 approaching a highway 16 warning sign 14 which has been constructed using a blank sign, magnetic lettering and a template which was used in the placement of the warning sign message 18. Sign 14 is attached to pole or support 15 which is placed in the ground 17.

Turning to FIG. 1A, shown therein is an enlarged front elevation view of the sign 14 of the present invention 10 as shown in FIG. 1. Shown is a sign blank 20 having a road warning message 18 assembled thereon using the template of the present invention 10 to determine the proper placement of said letters as explained hereinafter.

Figure 1B:
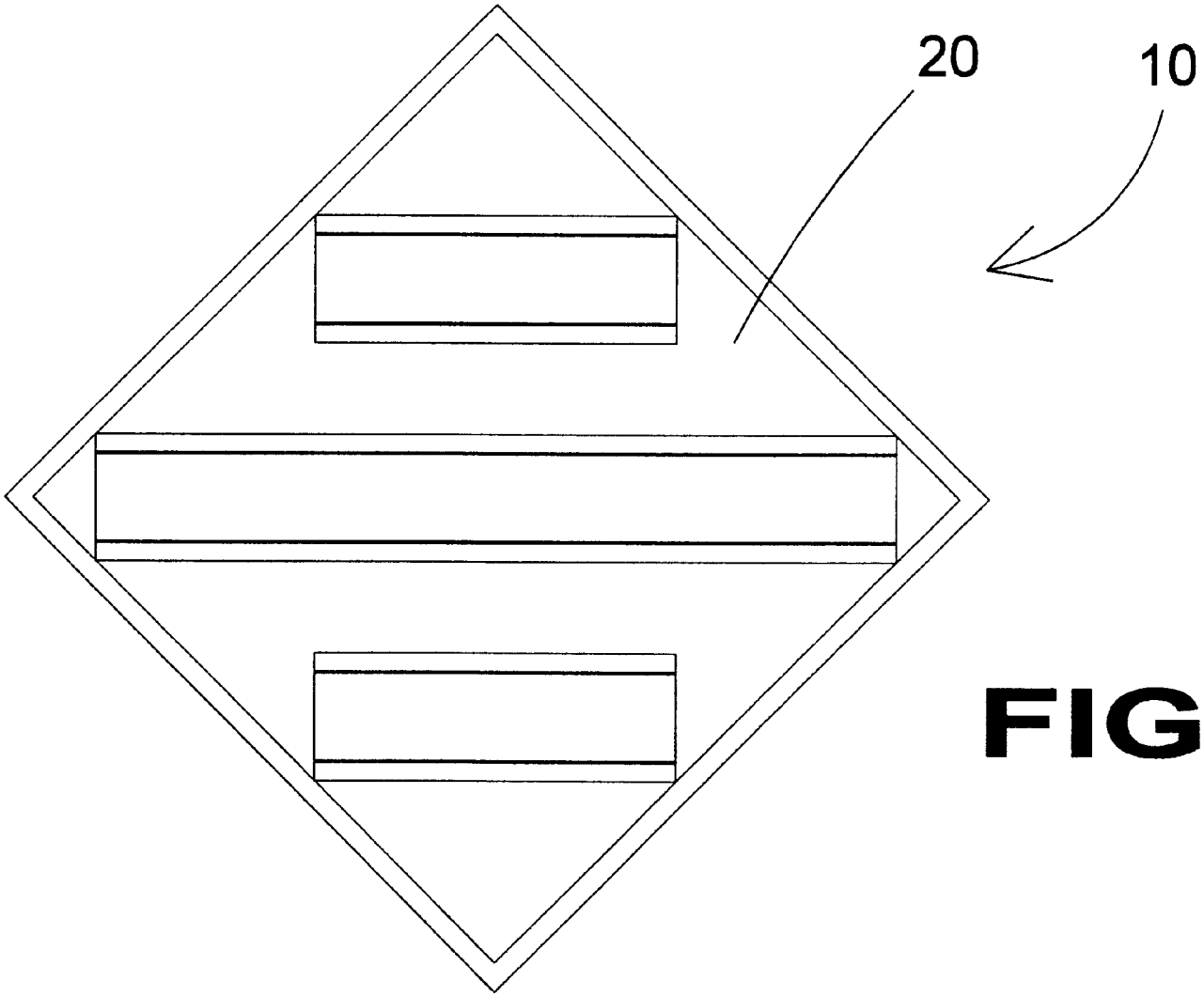
FIG. 1B is a front elevation of the sign blank of the present invention which will be used as the base for the placement of the lettering used in the warning sign.

Turning to FIG. 1B, shown therein is a front elevation of the sign blank 20 of the present invention 10 which will be used as the base member for the placement of the lettering used in the warning sign.

Figure 1C:
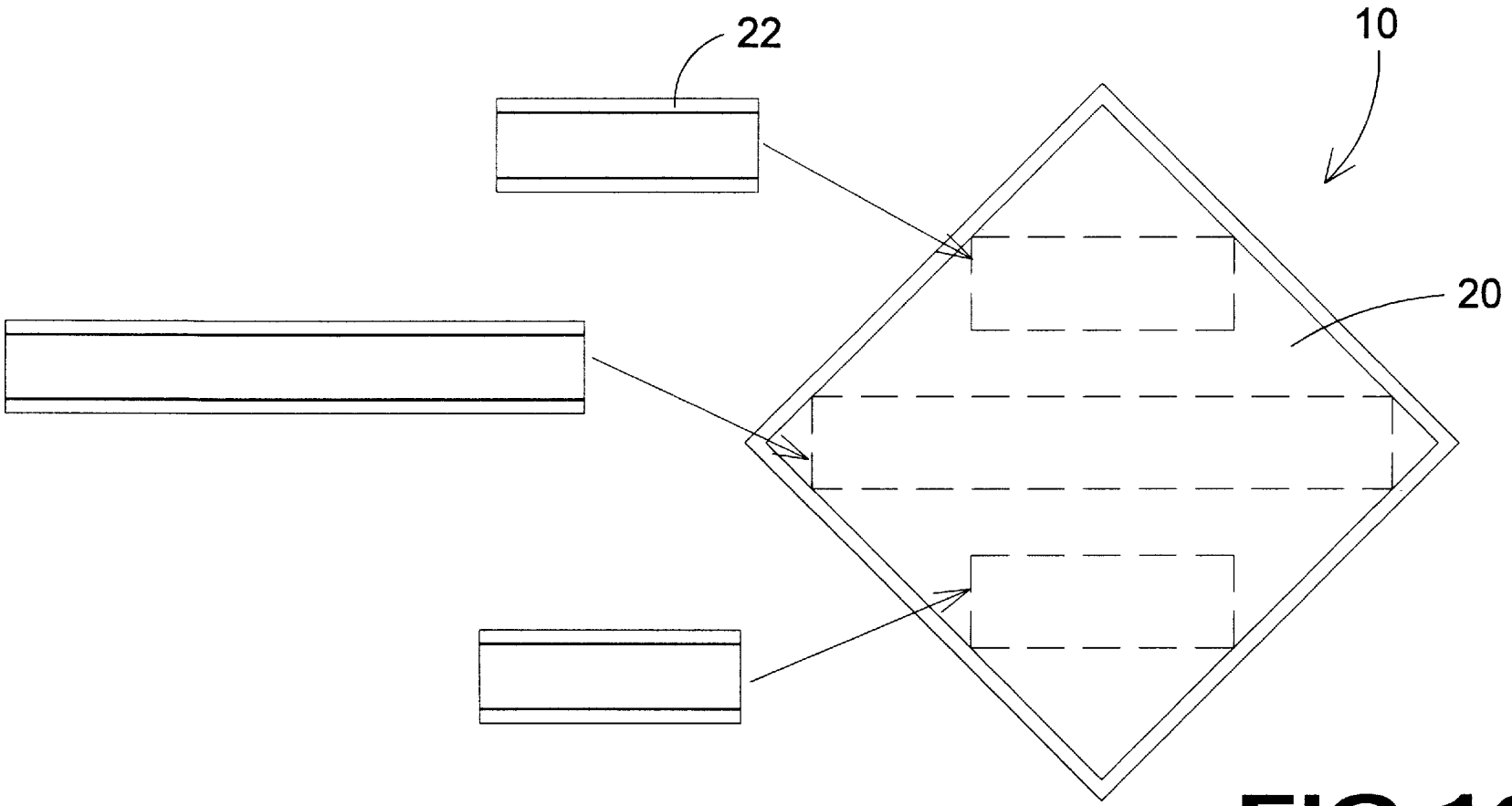
FIG. 1C is a front elevation of the sign blank of the present invention showing the ferrous material removed from the sign blank.

Turning to FIG. 1C, shown therein is a front elevation of the sign blank 20 of the present invention 10 showing the ferrous material 22 removed from the sign blank 20.

Figure 1D:
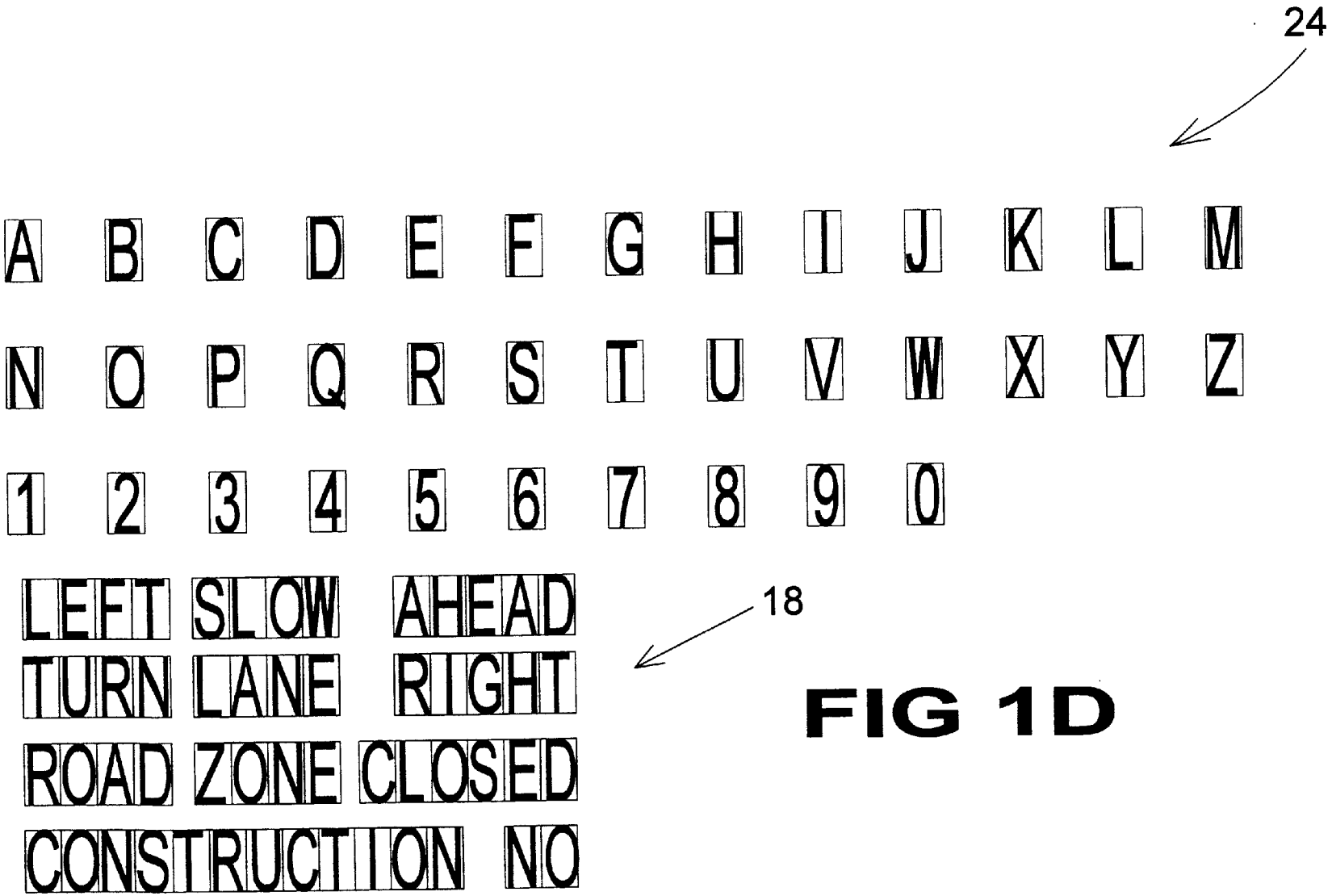
FIG. 1D is an illustration of some of the letters which can be enclosed with the kit of the present invention.

Turning to FIG. 1D, shown therein is an illustration of some of the array or plurality of letters and numbers 24 which can be enclosed with the kit of the present invention 10 and used to create various types of warning messages 18 for the road signs.

Figure 2:
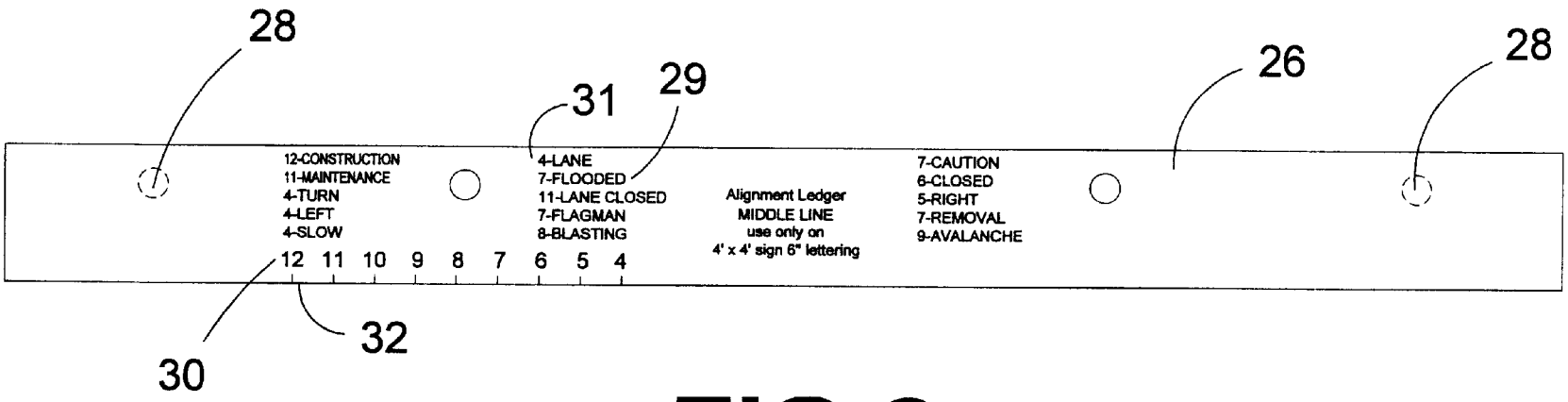
FIG. 2 is a front elevation of the template of the present invention. Shown in dotted are two alignment projections located on the rear of the template which are used to position the template at the appropriate location on the sign. Also engraved, embossed or imprinted on the template are commonly used words found on warning signs. Also shown are numbers and tic marks indicating the positioning of the first letter of the word being constructed on the sign blank. This side of the template will align with the middle row of the warning sign when placed at the top of the sign.

Turning to FIG. 2, shown therein is a front elevation of the template 26 of the present invention. Shown dotted are two alignment projections 28 located on the rear of the template 26 which are used to position the template 26 at the appropriate location on the sign blank 20 as will be explained hereinafter. Also engraved, embossed or imprinted on the template 26 are commonly used exemplary words 29 found on warning signs along with the number of letters 31 contained therein. Also shown are numbers 30 and tic marks 32 indicating the positioning of the first letter of the word being constructed on the sign blank. This front side of the template 26 will align with the middle row of the warning sign when placed at the top of the sign 20 as will be explained hereinafter.

Figure 3:
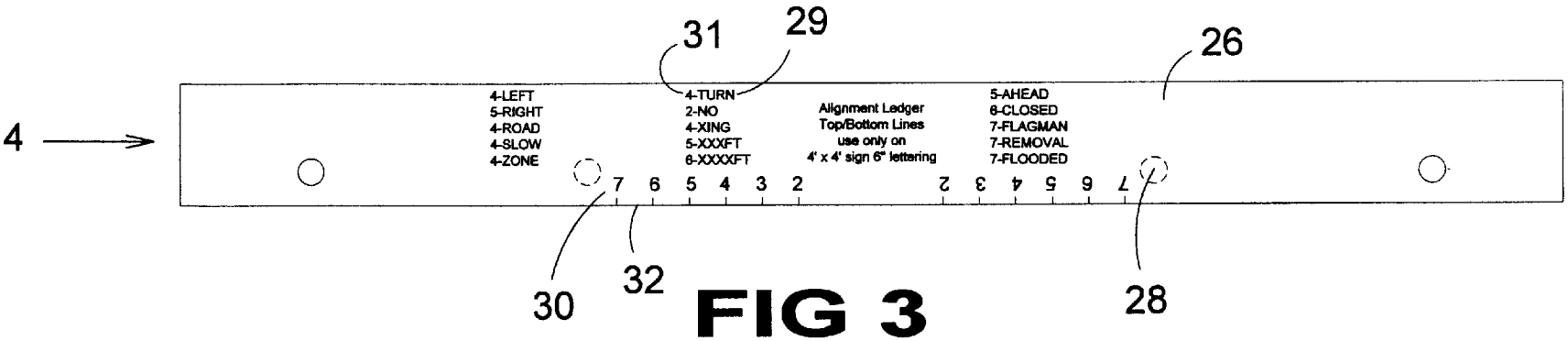
FIG. 3 is a rear elevation of the template of the present invention. Shown in dotted are two alignment projections located on the rear of the template which are used to position the template at the appropriate location on the sign. Also engraved, embossed or imprinted on the template are commonly used words found on warning signs. Also shown are numbers and tic marks indicating the positioning of the first letter based on the number of letters in the word being constructed. This side of the template will align with the first row of the warning sign when placed at the top of the sign. When rotated 180 degrees and held to the bottom of the sign the template will align with the third row of the warning sign.

Turning to FIG. 3, shown therein is a rear elevation of the template 26 of the present invention. Shown dotted are two alignment projections 28 located on the rear of the template 26 which are used to position the template 26 at the appropriate location on the sign. Also engraved, embossed or imprinted on the template are commonly used exemplary words 29 found on warning signs along with the number of letters 31 contained therein. Also shown are numbers 30 and tic marks 32 indicating the positioning of the first letter based on the number of letters in the word being constructed. This rear side of the template 26 will align with the first row of the warning sign 20 when placed at the top of the sign. When rotated 180 degrees and held to the bottom of the sign 20 the template 26 will align with the third row of the warning sign.

Figure 4:
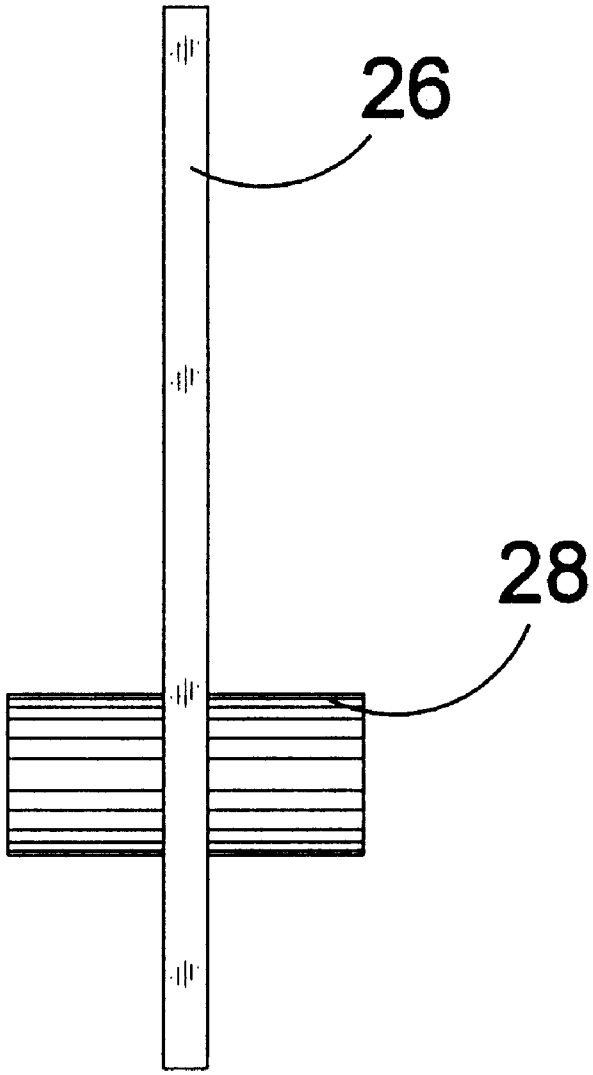
FIG. 4 is a side view of the template showing the alignment projections of the template.

Turning to FIG. 4, shown therein is a side view of the template 26 showing the front and rear alignment projections 28 of the template perpendicular to the template.

Turning to FIG. 5, shown therein is a front elevation of a warning sign blank 20 being constructed with. Shown is the template 26 in operative connection placed on the top edges 34 of the sign 20 for positioning the first word of sign text. Since the first word 36 has four letters 24 the upper left hand corner of the first letter is placed under the tic mark 32 labeled four to insure proper placement and positioning of the word 36 on the sign 20.

Turning to FIG. 5A, shown therein is a front elevation of the warning sign blank 20 shown in FIG. 5. Shown is the first word 36 having been completed. The template 26 is then reversed and again placed on the top edges 34 of the sign 20 wherein it will align with the second row. Since the second word 38 has twelve letters, the upper left hand corner of the first letter is placed under the tic mark 32 labeled twelve to insure proper placement and positioning of the word 38 on the sign 20.

Turning to FIG. 5B, shown therein is a front elevation of the warning sign blank 20 shown in FIGS. 5 and 5A. Shown is the first word 36 and the second word 38 having been completed. The template 26 is then reversed and placed on the bottom edge 40 of the sign 20 wherein it will align with the third row. Since the third word 42 has five letters, the lower left hand corner of the first letter is placed above the tic mark 32 labeled five to insure proper placement and positioning of the word 42 on the sign 20.

Turning to FIG. 6, shown therein is a cross sectional view of the present invention taken from FIG. 1A as indicated. Shown is a backing material 44 used for the flat body of the blank sign 20 having magnetic or ferrous-like strips 46 embedded within the backing material 44 having an upper ledge 48 and lower ledge 50. The upper ledge 48 is used to support the template 26 in a parallel horizontal position from the center of the sign 20 and the lower ledge 50 is used to support the magnetized letters 24. The blank sign 20 could also be made of ferrous material so that the magnetic letters 24 could be attached directly thereto.

Turning to FIGS. 7–7A, shown wherein is a description of the method used to create a warning sign from the components of the sign kit.

What is claimed to be new and desired to be protected by Letters Patent is set forth in the claims:

1. A kit for preparing a road sign, comprising:

a) a sign blank having a substantially flat body including a front surface;

b) a plurality of strips for placement of letters for the road sign;

c) said strips further comprising ferrous material;

d) a plurality of letters for composing appropriate words and phrases for use on the road sign;

e) wherein said letters are magnetic for attachment to said strips;

f) a template for properly positioning said letters, said template having a substantially flat body;

g) means for supporting said sign blank, whereby a road sign is formed; and h) said plurality of strips being embedded into said sign blank and having an upper ledge for receiving said template.

2. The kit of claim 1, said plurality of strips further comprising a lower ledge thereon, said lower ledge for receiving said letters.

3. The kit of claim 2, further comprising a plurality of alignment projections positioned on said template for cooperation with said sign blank for proper positioning of said letters.

4. The kit of claim 3, wherein said plurality of alignment projections are positioned on a front surface of said template, said alignment projections being perpendicular to said template.

5. The kit of claim 4, further comprising a plurality of alignment projections positioned on a rear surface of said template, said alignment projections being perpendicular to said template.

6. The kit of claim 5, further comprising multiple numbers, said numbers visibly placed on said template and said numbers allowing said letters to be properly positioned on said sign.

7. The kit of claim 5, further comprising multiple tic marks, said tic marks visibly placed on said template, said tic marks allowing said letters to be properly positioned on said sign.

8. The kit of claim 1, wherein said sign is substantially diamond shaped.

* * * * *